United States Patent [19]

Goldman

[11] Patent Number: 4,972,535

[45] Date of Patent: Nov. 27, 1990

[54] REVERSIBLE CONTOURED BODY SUPPORT MATTRESS

[75] Inventor: Mannie S. Goldman, 7008 Calvert Ave., Ventnor, N.J. 08406

[73] Assignees: Mannie S. Goldman; Dominick Mack, both of Ventor, N.J.

[21] Appl. No.: 400,452

[22] Filed: Aug. 30, 1989

[51] Int. Cl.[5] ..... A47C 27/15

[52] U.S. Cl. ..... 5/464; 5/481

[58] Field of Search ..... 5/481, 464, 431, 448, 5/468, 462, 443

[56] References Cited

U.S. PATENT DOCUMENTS

| | | | |
|---|---|---|---|
| 1,548,728 | 8/1925 | Milam | 5/462 |
| 3,885,258 | 5/1975 | Regan | 5/464 |
| 4,218,792 | 8/1980 | Kogan | 5/464 |
| 4,288,879 | 9/1981 | Pate | 5/431 |
| 4,564,246 | 1/1986 | Thieme | 297/457 |
| 4,620,337 | 11/1986 | Williams et al. | 5/481 |
| 4,665,573 | 5/1987 | Fiore | 5/464 |
| 4,673,452 | 6/1987 | Awdhan | 5/481 |

FOREIGN PATENT DOCUMENTS

| | | | |
|---|---|---|---|
| 3805980 | 9/1988 | Fed. Rep. of Germany | 5/481 |

*Primary Examiner*—Alexander Grosz
*Attorney, Agent, or Firm*—Louis Weinstein

[57] ABSTRACT

A reversible contoured body support mattress is formed of a foam block having a first major surface which is convoluted to form a regular pattern of hills and valleys. The opposite major surface is contoured in mutually perpendicular directions to provide a configuration which substantially conforms to the body shape in both the longitudinal and latitudinal directions, yielding a structure having therapeutic values for users, with or without spinal problems. As an alternative, the mattress may be formed of a first convoluted layer affixed to a second contoured layer wherein the contoured surface may be either affixed to or remote from the flat surface of the convoluted layer.

5 Claims, 6 Drawing Sheets

REVERSIBLE CONTOURED BODY SUPPORT MATTRESS

FIELD OF THE INVENTION

The present invention relates to mattresses and more particularly to a novel therapeutic mattress or support having a convoluted surface and which is further contoured in mutually perpendicular directions on the opposite major face to substantially conform to the body of the user and thereby yield an excellent therapeutic effect.

BACKGROUND OF THE INVENTION

It has been known to utilize body supporting structures having a convoluted surface to provide a substantially uniform pattern of hills and valleys to yield a beneficial therapeutic effect. It is further known to utilize a body support mattress which is curved in the longitudinal direction to generally conform to the shape of the human form. However, neither of these two devices provide the proper support for the neck, shoulders, arms, thoracic region, buttocks, hamstring region, calves and heels, regardless of whether the human form is oriented in the supine, prone, or side position and further such supports do not conform to the shape of the human form in mutually perpendicular directions, thus failing to provide proper support for the body. Also the prior devices do not provide two positions (high and low) for the legs or feet.

BRIEF DESCRIPTION OF THE INVENTION

The present invention is characterized by comprising a foam mattress having first and second major faces. A first major face has a convoluted surface configuration defined by a uniform arrangement of peaks (or projections) and valleys to provide support of the body and yielding a significant therapeutic result.

The opposing major face of the mattress is contoured or otherwise shaped so as to provide curvatures in both the longitudinal and latitudinal directions so that the mattress substantially conforms to the shape of the body in all directions.

The mattress is reversible in the sense that the user may lie upon the convoluted major surface and obtain the dual therapeutic values of the convoluted surface coupled with the longitudinal and latitudinal contours assumed by the convoluted surface as a result of the body weight of the user. As an alternative, the user may rest directly upon the contoured surface while the convoluted surface acts as the support for the mattress, resting directly upon a supporting surface, such as the floor or other supporting device such as a bedspring or mattress or both. The therapeutic benefits of the convoluted surface are obtained, although to a lesser degree compared to when the body rests directly upon the convoluted surface. The latitudinal and longitudinal contours generally conform to the shape of the human form and provide the correct spinal support for the body regardless of whether the person lying upon the mattress assumes the supine, prone or side position. The reversibility feature enables one to lie upon the curved major surface with legs raised above the heart as is appropriate for certain medical problems. The body may also be oriented so that the feet and head are reversed in order to elevate the feet slightly above the head. The mattress is formed of a foam material which is suitably flexible to enable it to be propped-up when used, for example, on a bed such as a hospital or hospital-type bed having articulated upper and lower sections.

The mattress of the present invention, in one alternative embodiment, may be comprised of first and second layers, said first layer having a planar major face and a convoluted opposing major face and a second layer having a planar major face and a major face which is curved in mutually perpendicular directions. The layers may be joined so that the planar surfaces of the first and second layers are joined together, or alternatively, so that the planar surface of the layer having the integral convoluted surface is joined to the surface of the second layer having the contours provided therein.

OBJECTS OF THE INVENTION AND BRIEF DESCRIPTION OF THE FIGURES

It is, therefore, one object of the present invention to provide a unitary support structure which provides a convoluted surface together with a contoured surface to yield the combined therapeutic value of providing a convoluted surface as well as a surface which generally conforms to the shape of the human form in mutually perpendicular directions.

Still another object of the present invention is to provide a novel therapeutic-type support which generally conforms to the human form in mutually perpendicular directions as well as providing a convoluted major surface and which is reversible so as to yield excellent therapeutic value when the body is resting upon either of the two major faces thereof.

Still another object of the present invention is to provide a unitary construction of the character described herein which is characterized by its ease of manufacture.

The above as well as other objects of the present invention will become apparent when reading the accompanying description and drawing, in which:

FIG. 1 shows a perspective view of a support design in accordance with the principles of the present invention.

FIG. 1*a* shows an end elevational view of the support of FIG. 1.

FIG. 1*b* shows a side elevational view of the support of FIG. 1.

FIG. 2 shows a perspective view, partially sectionalized, of the support of FIG. 1 with the convoluted major surface facing upward.

FIG. 2*a* shows an elevational view of the support of FIG. 2.

FIGS. 3 through 5 show side elevational views of the support of FIGS. 1 and 2 showing human form thereon, shown assuming various rest positions.

FIGS. 6*a*–6*e* show sectional views of the support of FIG. 1 looking in the direction of arrows 6*a*, 6*a* through 6*e*, 6*e*, respectively.

FIG. 7 shows an elevational view of another alternative embodiment of the present invention.

DETAILED DESCRIPTION OF THE INVENTION

Figure 1:
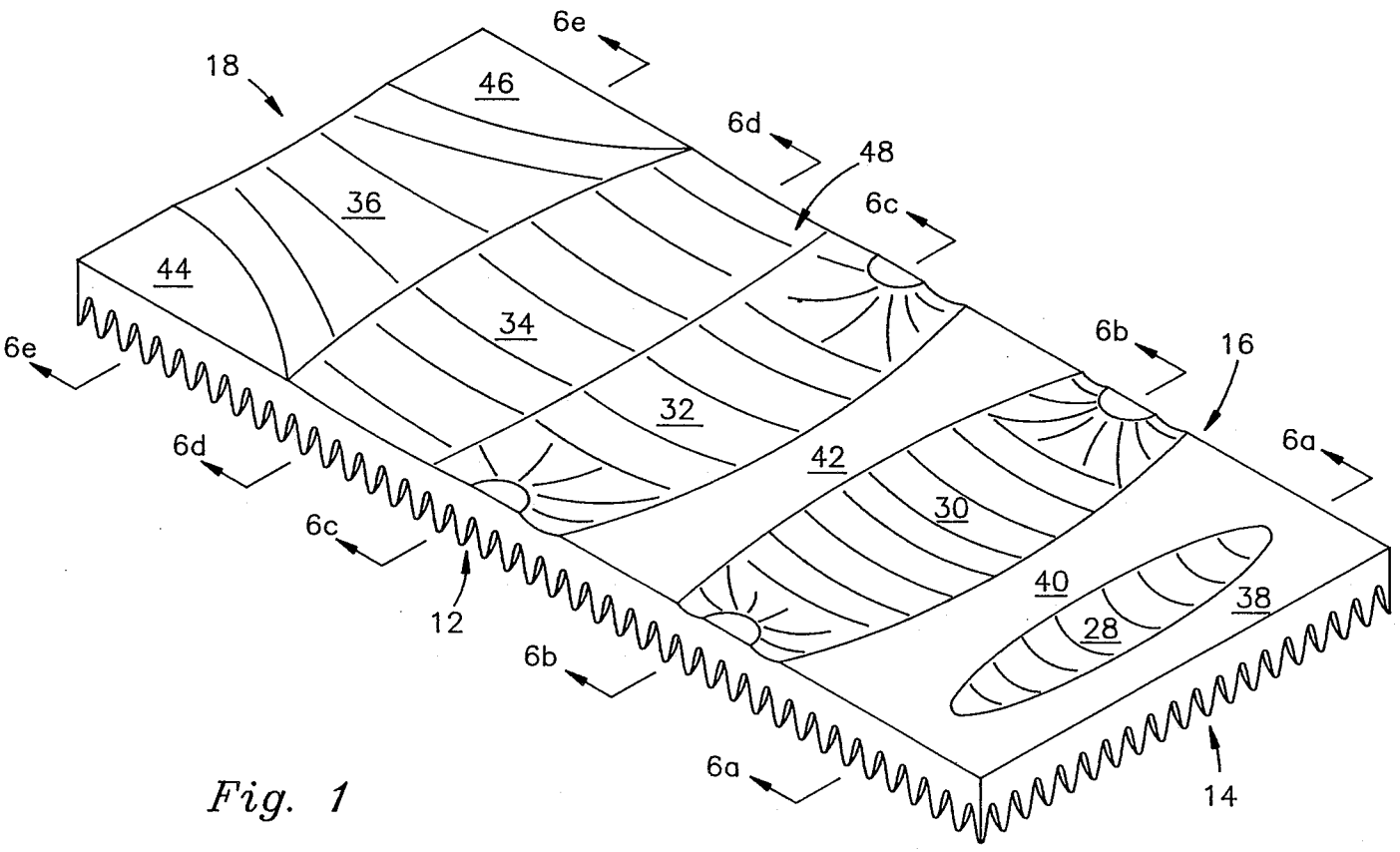
Figure 2:
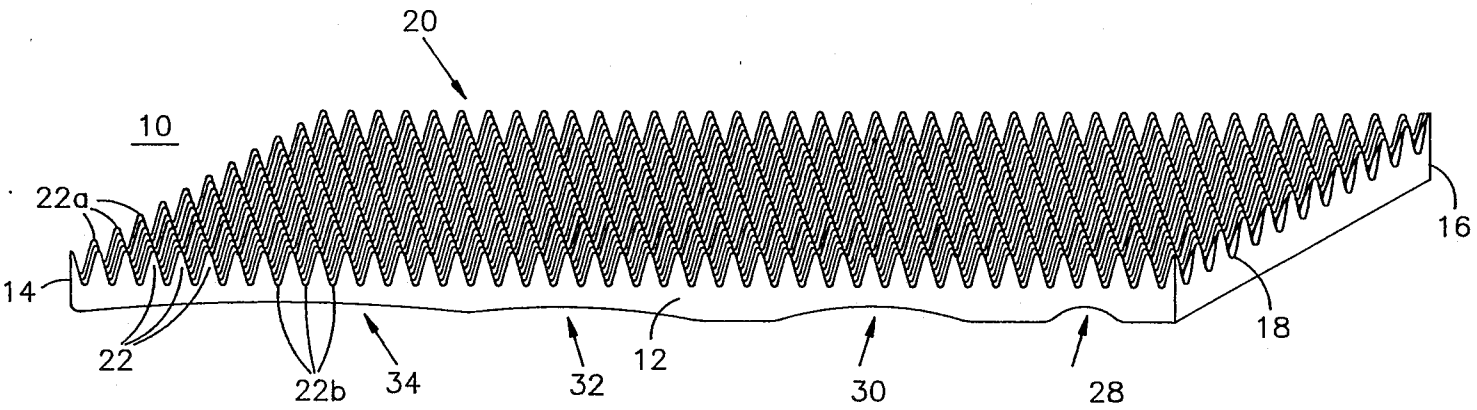
Figure 2A:
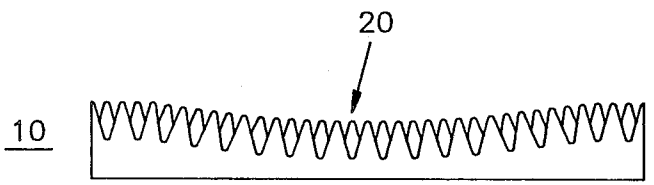

The support 10 shown in FIGS. 1 through 2*a* is comprised of a foam block preferably formed of a foam material such as, for example, polyurethane foam. However, any suitable foam rubber or rubber-like material having the requisite resiliency and compressibility, together with the ability to return to its normal expanded state when not in use, may be utilized.

The support 10 has a generally rectangular shape and is defined by two short vertically oriented sides 14 and 18 and two longer vertically oriented sides 12 and 16.

Top surface 20 (FIG. 2) is molded or otherwise prepared to provide a convoluted pattern of tapered, conical-shaped projections distributed over the top surface in a substantially uniform manner. Each projection 22 is a substantially tapered conical-shaped projection which is provided with a rounded tip 22*a*. The conical-shaped projections may alternatively be of generally-pyramidal shape and have either rounded or truncated tips, the projections of the latter type being substantially as effective as conical-shaped projections having either a rounded or a truncated tip. The bases of the "valleys" 22*b* surrounding each projection are likewise rounded. However, the bases may also be flat surfaces which form a vertex with projections of either conical or pyramidal shape.

The projections and valleys extend substantially and are uniformly distributed over the entire major surface 20 which is preferably of a rectangular shape and may vary in size from twenty-four by seventy-two (24″×72″) inches to thirty-six by eighty (36″×80″) inches to fifty-two by seventy-five (52″×75″) inches in order to respectively accommodate conventional bed sizes such as cot, twin, standard, full, queen and king. It should be understood that all of the above sizes yield the same support to the same parts of the body. The mattress can either be used alone or on a bed spring or may be placed upon a conventional mattress. The overall thickness of the support 10 is of the order of 4″to 6″.

The remaining major surface 26 (FIG. 1) is contoured in such a way as to provide a curvature shown, for example, in FIGS. 1, 1*a*, 1*b* and 5 which yields a curved configuration in mutually perpendicular (latitudinal and longitudinal) directions. Noting, for example, FIGS. 1*b* and 5, concave, curved portions 28, 30, 32, 34 and 36 are provided which extend generally in the longitudinal direction and are positioned and shaped to conform to the body form curvatures which respectively include the head, upper back, shoulders, buttocks, rear upper thigh, and calf of the leg and heel. The longitudinal curvature of surface 26 is further comprised of substantially flat--portions 38, 40, 42, 44 and 46. Flat portion 38 serves as a termination portion for the head end of the mattress. Flat portions 40 and 42 serve as regions for respectively supporting the portions of the body form including the neck and lower back. The high region 48 provides support between the thigh and the lower leg, i.e. the back of the knee. Flat portions 44 and 46 permit the lower legs to be raised by placement of the heels upon surfaces 44 and 46.

Figure 3:
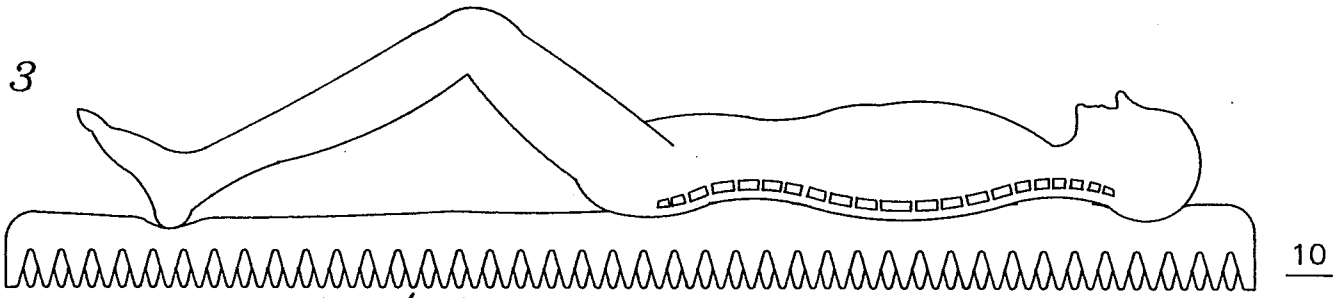
Figure 5:
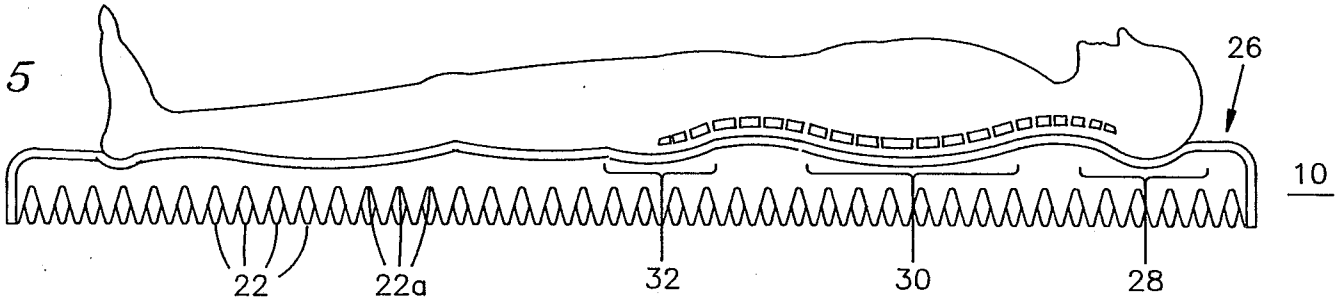
Figure 7:
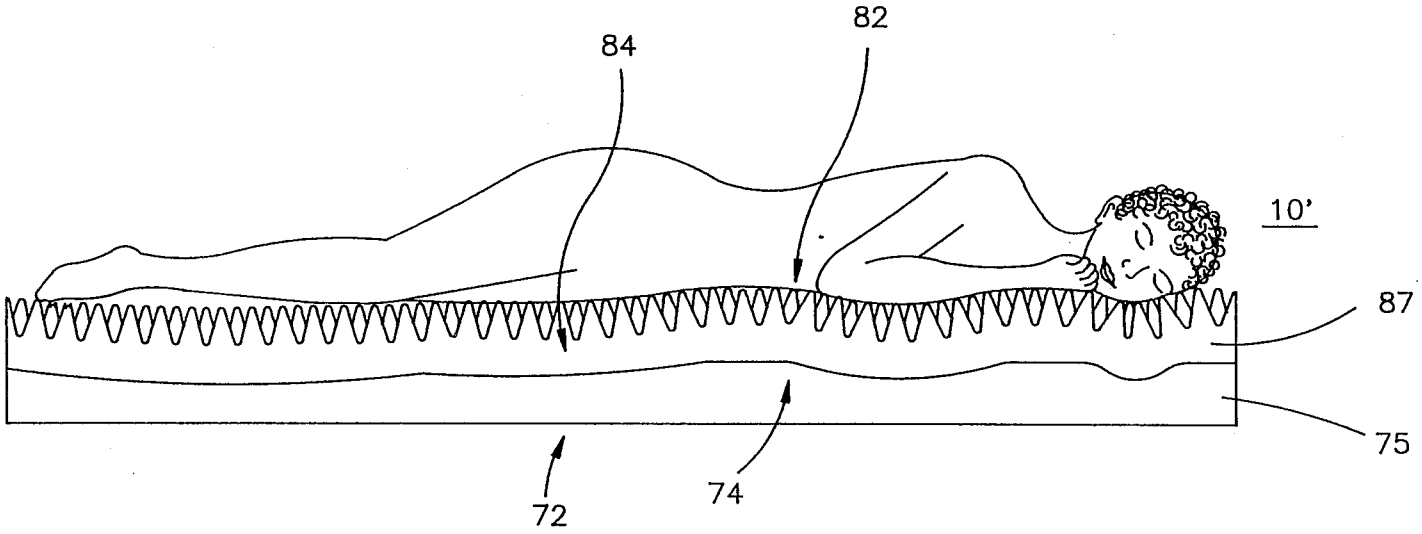

Considering the embodiments of FIGS. 3, 5 and 7, it can be seen that proper support for the neck, shoulders, arms, thoracic region, buttocks, hamstring region, calves and heels is provided regardless of whether the body form lying upon the mattress is in either the supine (FIG. 5) or side position (FIG. 7) or even in the case where the body form is lying upon the support mattress with the knees raised as shown in FIG. 3.

Figure 1A:
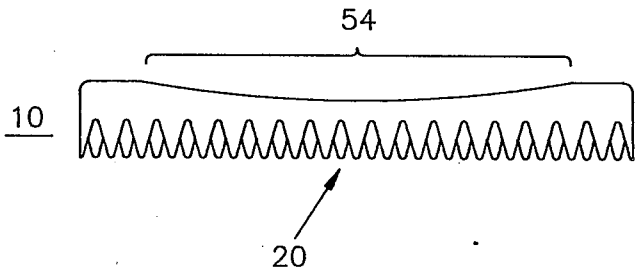
Figure 1B:
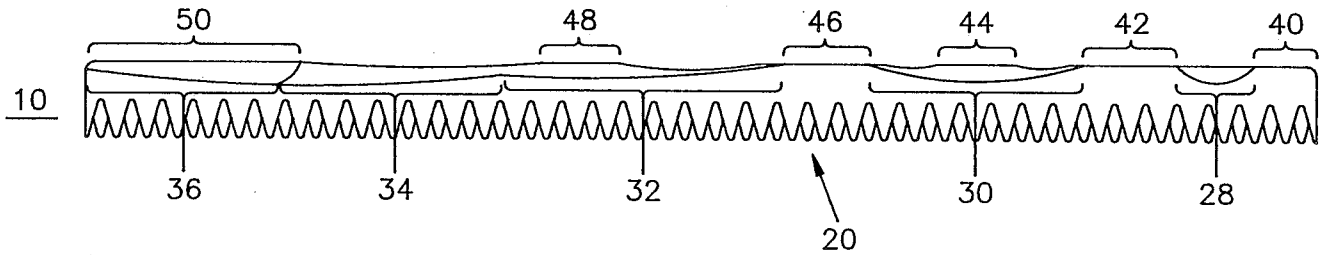
Figure 6A:
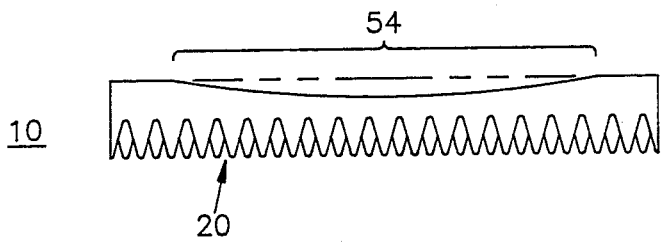
Figure 6B:
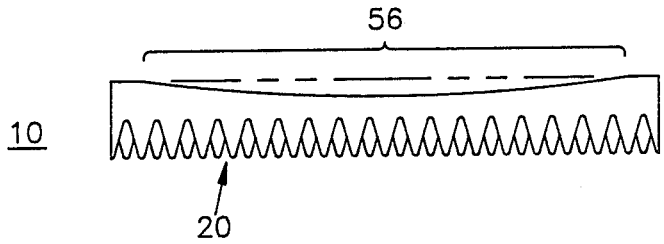
Figure 6C:
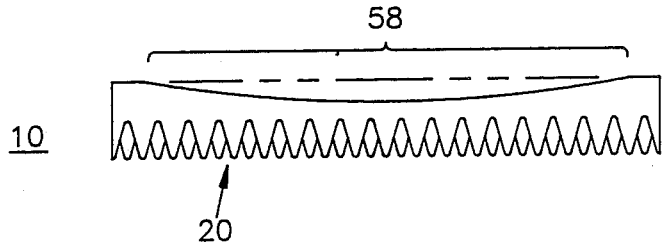
Figure 6D:
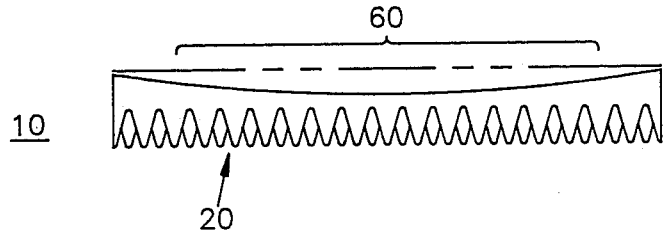
Figure 6E:
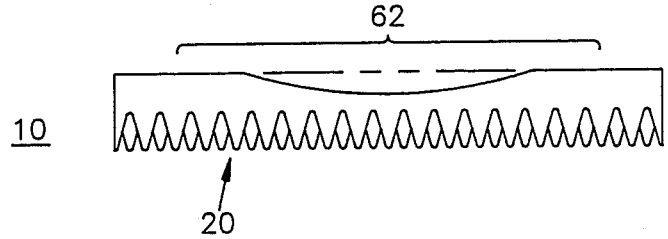

As can be seen from a consideration of both FIGS. 1 and 1*a*, the surface of major face 26 is curved in the latitudinal direction in order to conform to the curvature of the body form in the latitudinal direction. For example, the curved concave portion 54, shown in FIG. 6*a*, generally conforms to the latitudinal curvature of the head of the body form. Similarly, the concave longitudinal portions 30, 32 and 34 are provided with a concave curvature and, in a like fashion. Note latitudinal sections 56, 58, 60 and 62, respectively. (Note FIGS. 6*a*–6*e*, respectively.)

The portions of the support, being curved in mutually perpendicular directions (latitudinally and longitudinally) serve to provide latitudinal as well as longitudinal support and cradling of the body. For example, the regions supporting the head which includes longitudinal concave portion 28 and latitudinal concave portion 54 serves to cradle the head in both the latitudinal and longitudinal directions. The concave portions 28 and 30 cooperate to provide both support and cradling for the neck portion of the body form arranged therebetween. It can thus be seen that the remaining longitudinally curved concave portions 30 through 36 and the substantially flat portions 40 through 46 similarly provide support and/or cradling of regions of the body form supported thereon.

In addition to the fact that the resilient support of the present invention may be utilized with either the curved surface portion 39 or the convoluted portion 20 facing upwardly, it should further be understood that the body form may be oriented 180 degrees relative to the orientation shown in FIG. 5, for example, such that the head is resting upon the curved concave longitudinal portion 34 and so that the heel of the foot rests in the curved concave longitudinal portion 28, which orientation maintains the legs at a slightly higher level than the head and shoulders of the body form resting upon the support, thus yielding a support which may be utilized in a variety of different orientations and upon which the human form may assume a variety of different orientations.

The reversibility of the mattress is such that the convoluted side can be placed downwardly and away from the body and so that the body form rests upon the contoured major surface 26.

Figure 4:
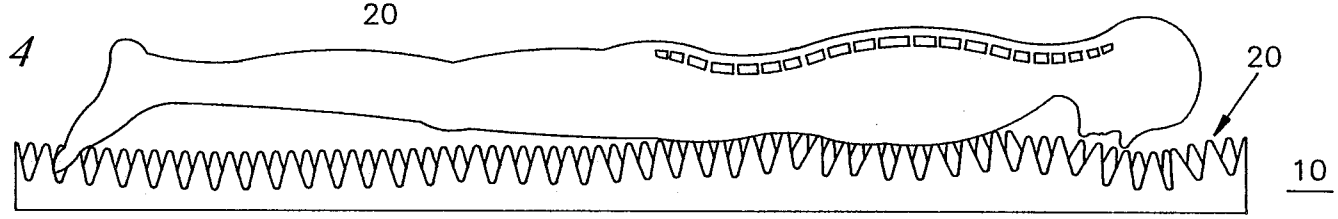

Alternatively, the convoluted side may be arranged facing upwardly as shown, for example, in FIG. 4 with the body form resting upon the convoluted surface 20 in the prone position. It should further be understood that the body form may rest upon the convoluted surface 20 in any of the positions shown in FIGS. 3, 5 and 7 namely, the supine position with the knees bent, the supine position with the knees straight, and the side position. The resiliency of the structure is such that the weight of the body upon the therapeutic support causes the curved major surface to become substantially flat as shown, for example, in FIG. 4, and thereby causes the convoluted surface to assume substantially the longitudinal and latitudinal curvatures which are present when the curved major surface 39 faces in the upward direction in order to provide proper support for the neck, shoulders, arms, thoracic region, buttocks, hamstring region, calves and heels. The support, even in the prone position with the convoluted surface facing upwardly, as shown in FIG. 4, provides the proper support for the aforementioned portions of the body. The same is also the case when the body form rests in the side position upon the curved or the convoluted surface.

FIG. 7 shows another alternative embodiment of the present invention in which the support 10′ is formed of separate layers 75 and 87. Layer 87 comprising a sheet of suitable foam material whose major face 82 is provided with the convolutions and whose opposite major face 84 is flat. Layer 70 is provided with a flat major face 72 and a curved major face 74 such that the major faces 74, 84, when joined by a suitable adhesive or by heat treatment or other techniques, the otherwise planar face 84 of layer 80 is caused to assume the curved configuration of the surface 74 of layer 70. The composite support 10′ of FIG. 8 may be utilized with either the convoluted surface 82 or the flat surface 72 facing upwardly. As an alternative to the arrangement shown in FIG. 7, the planar surfaces 72 and 84 of layers 70 and 80 respectively may be joined together so that the curved surface 74 of layer 70 is exposed. Either of these two arrangements of the composite support may be employed to construct the composite support.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A therapeutic support (10) for supporting a body form comprising:

a foam layer comprising a unitary one-piece body of uniform resiliency throughout and of substantially rectangular shape having a length (12) greater than the width (18) thereof and having first (20) and second (26) major faces each being of a size at least sufficient to accommodate a person of average size (see FIG. 5);

said first major face (20) having a plurality of projections (22) integral with said layer and extending upwardly from said first major face, said projections being distributed in a substantially uniform manner over said first major face;

said second major face (26) having a plurality of recesses (28, 30, 32, 34, 36) each being contoured in mutually perpendicular directions to provide curved concave surface portions arranged at predetermined locations along the longitudinal direction of said second major face, selected ones of said curved concave surface portions (28, 30, 32) being separated from one another by intervening substantially flat surface portions (40, 42) to yield a support capable of providing proper support for the neck (40), lower back (42), buttocks (32), knee (48), and ankle portions (between 34 and 36) of a body form when it is supported thereon;

each of said curved concave surface portions having a length and width dimension, the length dimensions each being substantially greater than the width dimension of the associated recess, the length dimension being transverse to the length of said second major face (26);

the length dimension of each curved concave surface portion being greater than the width of the body portion adapted to rest thereupon;

the curved concave recess (36) receiving the feet terminating a spaced distance inward from the longitudinal sides of the second major face, forming respective elevated resting areas (44, 46) for the left and right feet of a human form resting thereon to thereby elevate the feet to a level higher than the level of the feet when placed in the curved concave surface area (36) between said elevated resting areas (44, 46).

2. The therapeutic support of claim 1 wherein each of said curved concave longitudinal portions (28, 30, 32, 34, 36) is further contoured in the latitudinal direction so as to provide a concavity in the latitudinal direction in order to cradle the portion of the body form supported thereon.

3. The therapeutic support of claim 1 wherein the support is formed of a foamed plastic material which is of sufficient resiliency so as to assume the concavities of said second face of the support when a body form rests thereon when either the first or the second major face thereof faces upwardly and is engaged by the body form supported thereon.

4. The body of claim 3 wherein the foam material is a polymeric foam.

5. The support of claim 4 wherein said polymeric foam is a foamed polyurethane.

* * * * *